US008573729B2

(12) United States Patent
Takamoto

(10) Patent No.: US 8,573,729 B2
(45) Date of Patent: Nov. 5, 2013

(54) LIQUID EJECTION DEVICE

(75) Inventor: Tetsuya Takamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 219 days.

(21) Appl. No.: 13/010,973

(22) Filed: Jan. 21, 2011

(65) Prior Publication Data

US 2011/0193909 A1 Aug. 11, 2011

(30) Foreign Application Priority Data

Feb. 5, 2010 (JP) ..... 2010-024821

(51) Int. Cl.
*B41J 29/38* (2006.01)
*B41J 2/01* (2006.01)

(52) U.S. Cl.
USPC ..... 347/16; 347/101; 347/104; 347/105

(58) Field of Classification Search
USPC ..... 347/16
See application file for complete search history.

(56) References Cited

U.S. PATENT DOCUMENTS 6,543,948 B2 * 4/2003 Beehler et al. ..... 400/635

FOREIGN PATENT DOCUMENTS

| | | | | |
|---|---|---|---|---|
| JP | 05-131692 A | | 5/1993 | |
| JP | 2008-114409 A | | 5/2008 | |
| JP | 2008114409 | * | 5/2008 | ..... B41J 11/08 |
| JP | 2009-234128 A | | 10/2009 | |

* cited by examiner

*Primary Examiner* — Uyen Chau N Le
*Assistant Examiner* — Kajli Prince
(74) *Attorney, Agent, or Firm* — Global IP Counselors, LLP

(57) ABSTRACT

The liquid ejection device includes: a platen configured to hold a recording medium by suction through the use of a plurality of suction holes; a suction unit configured to generate a negative pressure for holding the recording medium to the platen by suction; a suction flow passage configured to transmit the negative pressure generated by the suction unit to the platen, the suction flow passage being disposed between the suction unit and the platen; and a communication control unit configured to control communication between the suction unit and the suction holes not blocked by the recording medium, through the use of a flow of air suctioned from the suction holes not blocked by the recording medium.

7 Claims, 8 Drawing Sheets

LIQUID EJECTION DEVICE

CROSS-REFERENCE TO RELATED APPLICATIONS

This application claims priority to Japanese Patent Application No. 2010-024821 filed on Feb. 5, 2010. The entire disclosure of Japanese Patent Application No. 2010-024821 is hereby incorporated herein by reference.

BACKGROUND

1. Technical Field

The present invention relates to a liquid ejection device such as an inkjet printer, for example.

2. Related Art

Inkjet recording devices are widely known as one type of conventional liquid ejection device. An inkjet recording device is provided with a carriage for mounting a recording head (liquid ejection head), and ink (liquid) is ejected from the recording head onto a paper sheet or other recording medium on which recording (printing) is performed while the head and the recording medium are moved relative to each other.

In this type of recording device, as shown in FIG. 11, in a case in which numerous suction holes 101 are provided to a platen 100, and a paper sheet 104 is suctioned by a suction fan 102 through a suction flow passage 103, a flow of air between the platen 100 and a head 106 mounted on a carriage 105 is created by the suction holes 101 that are not being used for suction, which causes flight deflection of ink particles and landing deviation (print misalignment) to occur. In Japanese Laid-Open Patent Publication No. 2009-234128, a configuration is described in which a shield for blocking the suction holes is moved synchronously with the carriage (head), and the suction holes near the head are thereby always blocked so that a flow rate does not occur.

SUMMARY

However, since the suction holes near the head are blocked, the print surface of the paper sheet tends to rise upward.

The present invention was developed in view of the problems described above, and an object of the present invention is to provide a liquid ejection device capable of suppressing landing deviation of the liquid from the liquid ejection head onto the recording medium, caused by a flow of air suctioned from the suction holes not blocked by the recording medium when suction is used to hold a recording medium that is less wide than the region in which the plurality of suction holes is arranged in the platen, and whereby suction can be provided from the suction holes that are necessary for suctioning the recording medium.

In order to achieve the abovementioned objects, a liquid ejection device according to a first aspect of the present invention includes a carriage, a platen, a suction unit, a suction flow passage and a communication control unit. The carriage is configured to mount a liquid ejection head for ejecting a liquid onto a recording medium. The platen has a plurality of suction holes, the platen holding the recording medium by suction using the suction holes, and the platen being disposed in a position facing a movement region of the carriage. The suction unit is configured to generate a negative pressure for holding the recording medium by suction to the platen. The suction flow passage is configured to transmit the negative pressure generated by the suction unit to the platen, the suction flow passage being disposed between the suction unit and the platen. The communication control unit is provided in the suction flow passage so that, when suction is used to hold the recording medium that is less wide than the region in which the suction holes are arranged, communication between the suction unit and the suction holes not blocked by the recording medium is controlled by a flow of air suctioned from the suction holes not blocked by the recording medium.

Through this configuration, the platen is disposed in a position facing the movement region of the carriage, and the platen is provided with a plurality of suction holes. The suction unit generates a negative pressure for holding the recording medium to the platen by suction. The negative pressure generated by the suction unit is transmitted to the platen through the suction flow passage provided between the suction unit and the platen, and the recording medium is held by suction through the use of the plurality of suction holes.

In this configuration, when using suction to hold a recording medium that is less wide than the region in which the plurality of suction holes is arranged, communication between the suction unit and the suction holes not blocked by the recording medium is controlled by the communication control unit in the suction flow passage, through the use of a flow of air suctioned from the suction holes not blocked by the recording medium.

Landing deviation of the liquid from the liquid ejection head onto the recording medium, caused by the flow of air suctioned from the suction holes not blocked by the recording medium, can thereby be suppressed when suction is used to hold a recording medium that is less wide than the region in which the plurality of suction holes is arranged in the platen. Suction can also be provided from the suction holes that are necessary for suctioning the recording medium.

In the liquid ejection device according to a second aspect, the communication control unit preferably includes a movable flow rate adjustment member and an urging section. The movable flow rate adjustment member is supported to rotate about a shaft center in the suction flow passage so as to enable adjustment of the rate of flow to the suction unit from the suction holes not blocked by the recording medium that is less wide than the region in which the suction holes are arranged. The urging section is configured to impart an urging force for maintaining a state in which the movable flow rate adjustment member is on a side in which communication is open between the suction unit and the suction holes not blocked by the recording medium when the suction unit is not operating.

Through this configuration, the movable flow rate adjustment member is supported so as to be able to rotate about a shaft center in the suction flow passage so as to enable adjustment of the rate of flow to the suction unit from the suction holes not blocked by the recording medium that is less wide than the region in which the plurality of suction holes is arranged, and by the urging section, a state can be maintained in which the movable flow rate adjustment member is on a side in which communication is open between the suction unit and the suction holes not blocked by the recording medium.

In the liquid ejection device according to a third aspect, the urging force of the urging section is preferably set so that when suction is used to hold a recording medium that is less wide than the region in which the plurality of suction holes is arranged, an oppositely directed moment that is weaker than a moment created at the shaft center acts by a pressure difference, which is created by a flow of air suctioned from the suction holes not blocked by the recording medium, between a space on the side of the movable flow rate adjustment member toward the suction unit and on the side of the movable flow rate adjustment member toward the suction holes not blocked by the recording medium, and a state is achieved in which the movable flow rate adjustment member is on the side of reducing the rate of flow toward the suction unit from the suction holes not blocked by the recording medium.

Through this configuration, when using section to hold a recording medium that is less wide than the region in which the plurality of suction holes is arranged, an oppositely directed moment that is weaker than a moment created at said shaft center acts by a pressure difference, which is created by a flow of air suctioned from the suction holes not blocked by the recording medium, between a space on the side of said movable flow rate adjustment member toward said suction unit and on the side of said movable flow rate adjustment member toward the suction holes not blocked by the recording medium, and the urging section places the movable flow rate adjustment member in a state in which the movable flow rate adjustment member is on the side of reducing the rate of flow toward the suction unit from the suction holes not blocked by the recording medium. The movable flow rate adjustment member can thereby be rotated to a state in which the movable flow rate adjustment member is on the side of reducing the flow rate.

In the liquid ejection device according to a fourth aspect, the communication control unit preferably includes a range limiter with which the movable flow rate adjustment member comes in contact in the state on the side of reducing the flow rate. When the movable flow rate adjustment member is in contact with the range limiter, a gap is preferably present in the suction flow passage between the suction unit and the suction holes not blocked by the recording medium.

Through this configuration, when the movable flow rate adjustment member is in contact with the range limiter, the fact that a gap is present in the suction flow passage between the suction unit and the suction holes not blocked by the recording medium allows the movable flow rate adjustment member to be readily adjusted.

In the liquid ejection device according to a fifth aspect, the urging section is preferably a torsion coil spring.

Through this configuration, since the urging section is a torsion coil spring, the variation in the urging force can be made smaller when the rotatably supported movable flow rate adjustment member is rotated.

BRIEF DESCRIPTION OF THE DRAWINGS

Referring now to the attached drawings which form a part of this original disclosure.

DETAILED DESCRIPTION OF EXEMPLARY EMBODIMENTS

Embodiments in which the present invention is applied to an inkjet printer (sometimes abbreviated as "printer" hereinafter) as one type of liquid ejection device will be described below with reference to FIGS. 1 through 9.

In the following description, the "X-axis direction," the "Y-axis direction," and the "Z-axis direction" refer to the direction in which a paper sheet is conveyed, indicated by arrows in FIG. 1, the direction orthogonal to the conveyance direction in the horizontal plane, and the vertical direction orthogonal to both of the conveyance direction and the direction orthogonal to the conveyance direction.

Figure 1A:
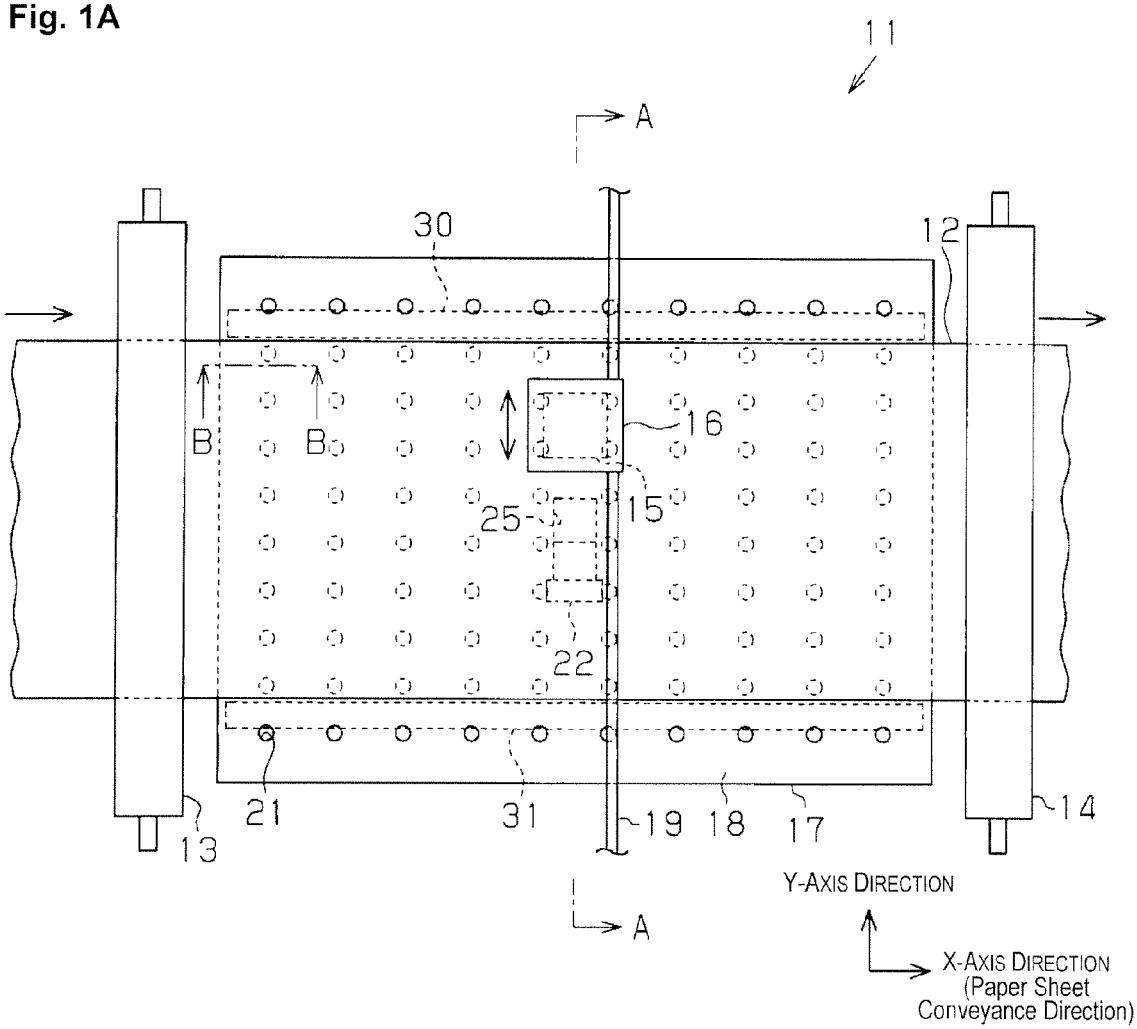
FIG. 1A is a schematic plan view showing the printer according to an embodiment.
Figure 1B:
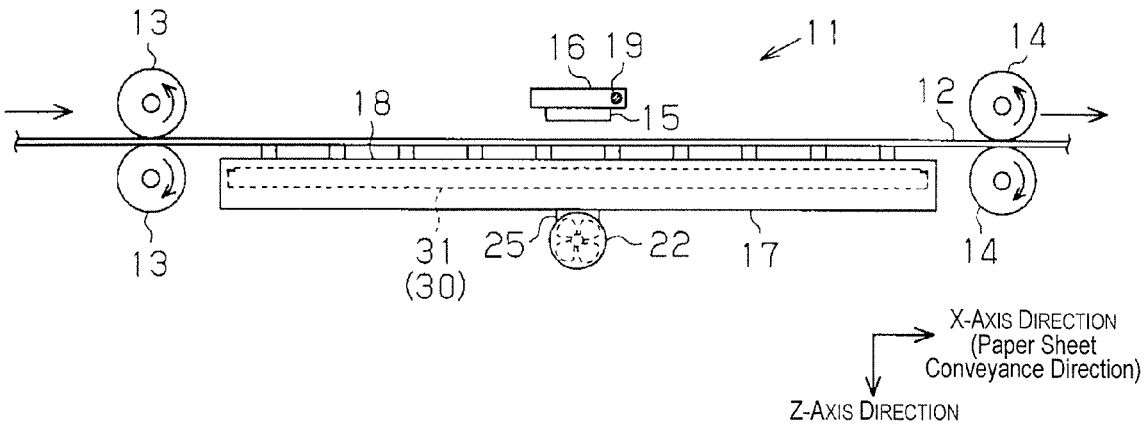
FIG. 1B is a schematic front view showing the printer.

As shown in FIG. 1, the inkjet printer 11 serving as a recording device is provided with paper feed rollers 13 and paper delivery rollers 14 for conveying a paper sheet 12 as a recording medium; a carriage 16 for mounting a recording head (print head) 15 as a liquid ejection head; and a platen 18 composed of the top plate of a flat casing 17. The carriage 16 is provided above the platen 18.

A pair of upper and lower paper feed rollers 13 extending in the Y-axis direction are provided on the left side of the platen 18 in the X-axis direction, and can be rotatably driven by a drive motor not shown in the drawing. A pair of upper and lower paper delivery rollers 14 extending in the Y-axis direction are provided on the right side of the platen 18 in the X-axis direction, and can be rotatably driven by a drive motor not shown in the drawing. The paper sheet 12 is conveyed in the X-axis direction along the top surface of the platen 18 by the rotation of the rollers 13, 14.

The carriage 16 is passed through a guide shaft 19 which extends in the Y-axis direction orthogonal to the conveyance direction of the paper sheet 12, and the carriage 16 is moved in the Y-axis direction along the guide shaft 19. A nozzle is opened in the bottom surface in the recording head 15 mounted to the carriage 16. Ink serving as a liquid is ejected from the nozzle toward the paper sheet 12 below, and printing is thereby applied to the paper sheet 12.

Figure 2:
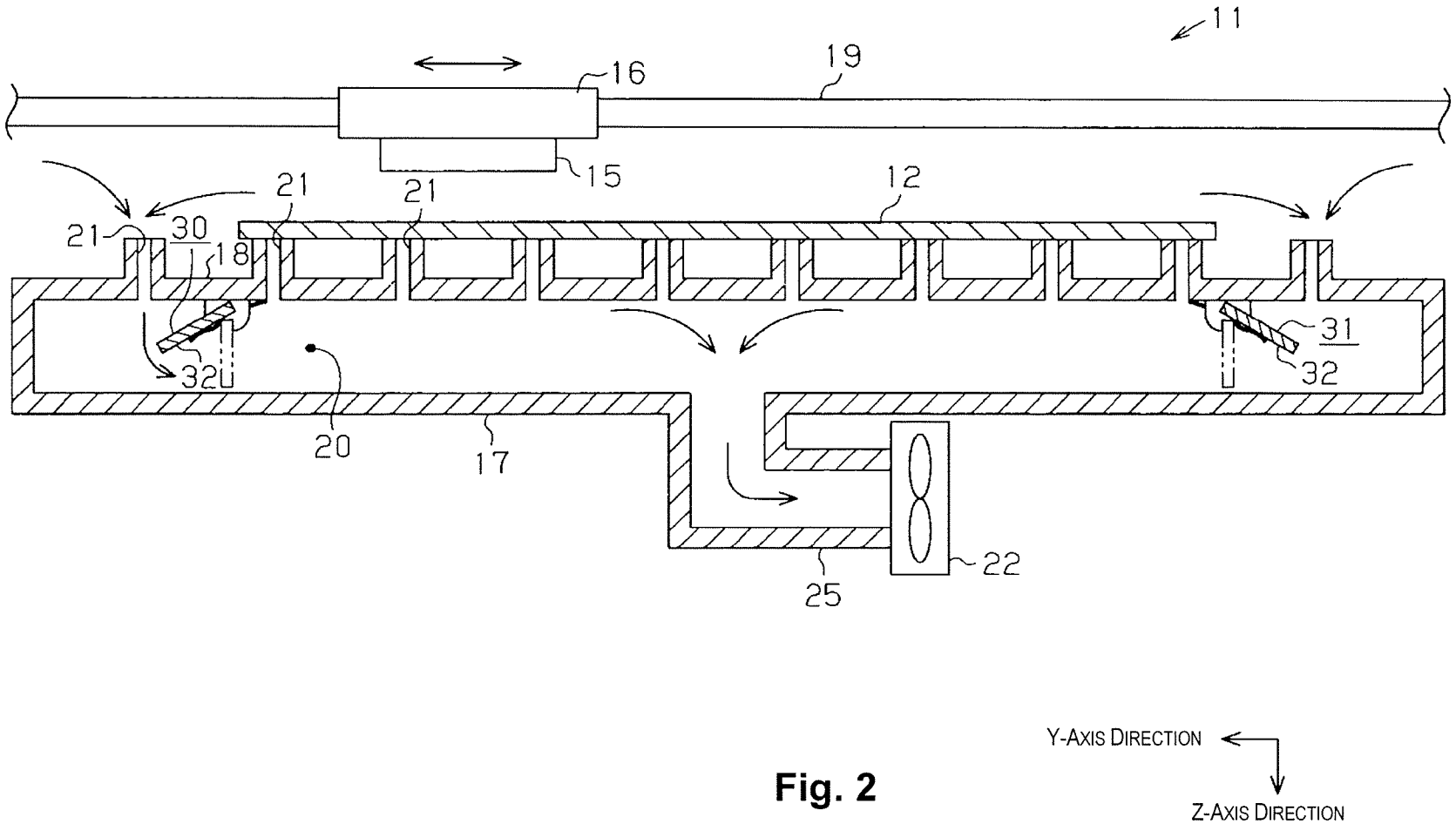
FIG. 2 is a schematic sectional view showing a longitudinal section along line A-A of FIG. 1A.

The platen 18 positioned facing the movement region of the carriage 16 has a rectangular plate shape elongated in the X-axis direction. The platen 18 is configured so as to block an open portion of the top surface of the casing 17, and the inside of the casing 17 forms a suction flow passage (pressure chamber) 20, as shown in FIG. 2.

Figure 10:
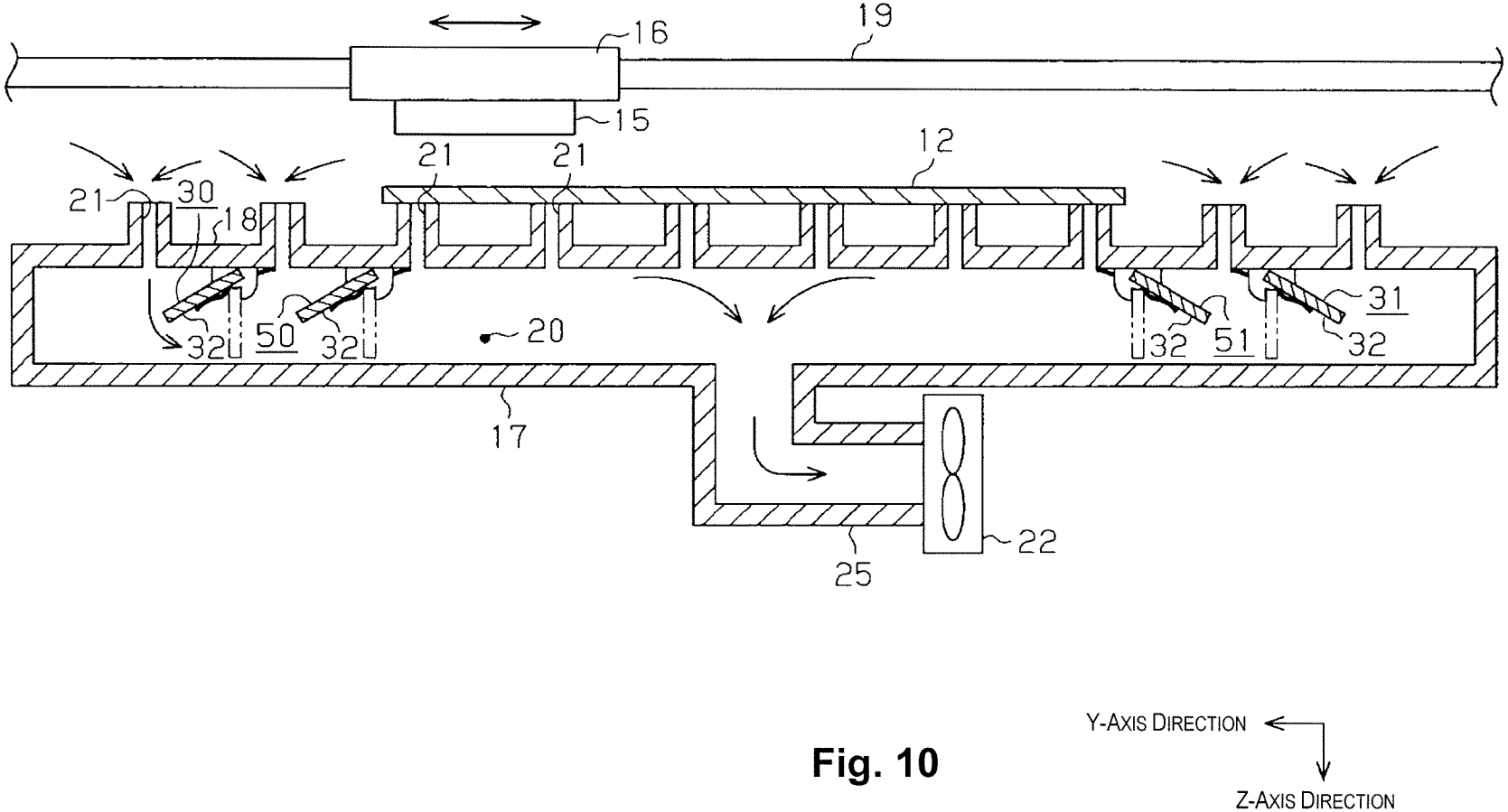
FIG. 10 is a schematic sectional view showing the printer according to another example.
Figure 11:
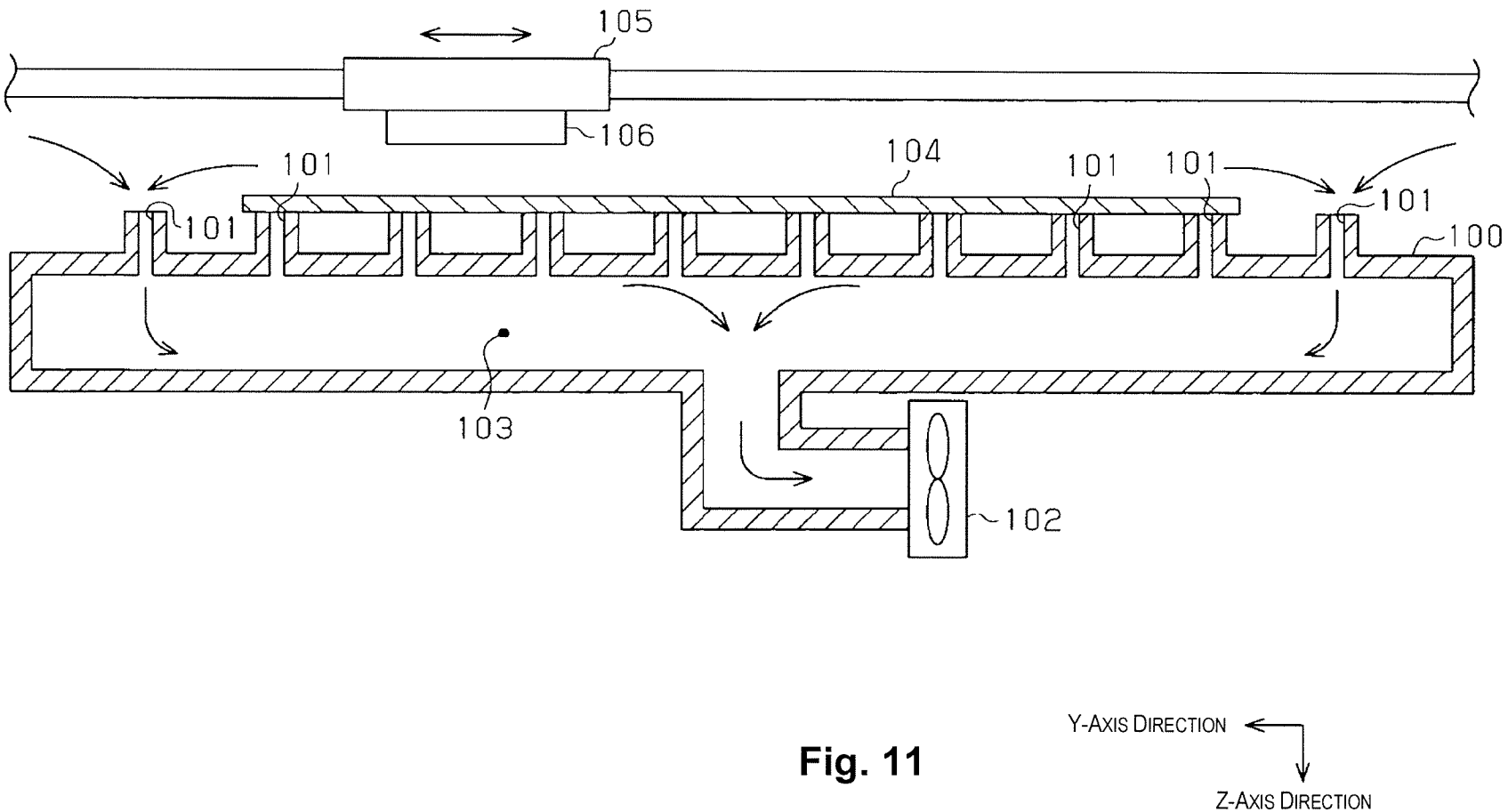
FIG. 11 is a schematic sectional view showing the printer.

The platen 18 is provided with a plurality of pipe-shaped suction holes 21 which extend upward, and the paper sheet 12 is held by suction through the plurality of suction holes 21. The plurality of suction holes 21 is formed so as to be aligned along a straight line at a constant pitch in the X-axis direction, which is the conveyance direction of the paper sheet 12, and is arranged at a constant pitch in the Y-axis direction orthogonal to the conveyance direction of the paper sheet. In FIGS. 1 and 2, 10 rows of suction holes 21 are arranged in the Y-axis direction orthogonal to the conveyance direction of the paper sheet.

A suction fan 22 serving as a suction unit is provided to the printer 11. A negative pressure is generated by the driving of the suction fan 22. The suction fan 22 and the suction flow passage (pressure chamber) 20 inside the casing 17 are connected by a suction duct 25, and one end of the suction duct 25 is open at the center of the bottom surface of the casing 17.

The negative pressure for holding the paper sheet 12 to the platen 18 by suction, generated by the driving of the suction fan 22, is transmitted to the suction flow passage (pressure chamber) 20 inside the casing 17 via the suction duct 25. In other words, the suction flow passage 20 is provided to the printer 11, the suction flow passage 20 is disposed between the suction fan 22 and the platen 18, and the negative pressure generated by the suction fan 22 is transmitted to the platen 18 by the suction flow passage 20.

The inkjet printer 11 thus uses a suction-type platen 18, and when the paper sheet 12 is positioned facing the top surface of the platen 18, the paper sheet 12 is suctioned toward the platen 18 by the suction created by the suction fan 22. The paper sheet 12 positioned facing the top surface of the platen 18 is thereby supported by the platen 18.

A first communication control member 30 and second communication control member 31 serving as a communication control unit are provided in the suction flow passage (pressure chamber for the platen) 20 inside the casing 17, as shown in FIG. 1. The first communication control member 30 and the second communication control member 31 have the same configuration.

Figure 3:
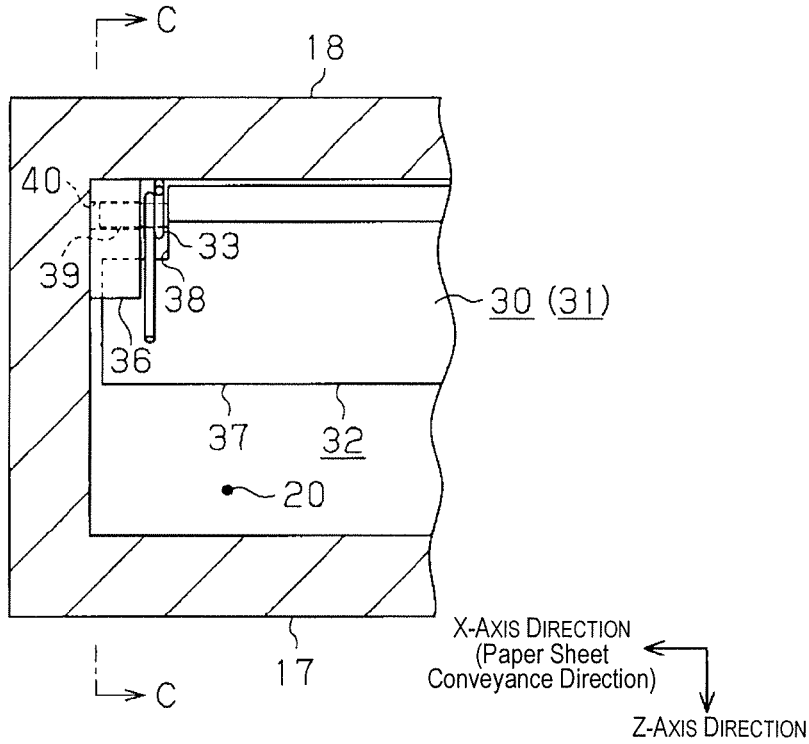
FIG. 3 is a schematic sectional view showing a longitudinal section along line B-B of FIG. 1A.
Figure 4:
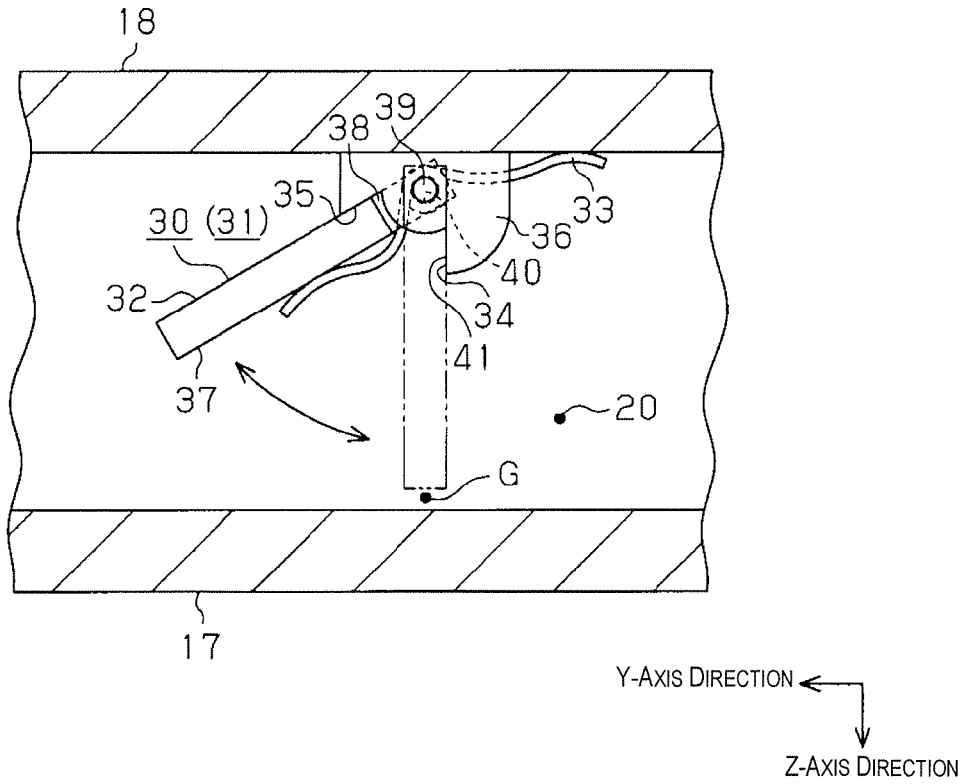
FIG. 4 is a schematic sectional view showing a cross-section along line C-C of FIG. 3.

As shown in FIGS. 3 and 4, each of the first communication control member 30 and the second communication control member 31 is provided with a movable shield plate 32 having an elongated rectangular shape and serving as a movable flow rate adjustment member, a torsion coil spring (coil spring) 33 serving as an urging section for imparting rotational force to the movable shield plate 32, and a bracket 36 having range limiters 34, 35.

When using suction to hold a paper sheet 12 that is less wide than the region in which the plurality of suction holes 21 is arranged, the movable shield plates 32 of the communication control members 30, 31 are rotated against the urging force of the torsion coil springs 33 by a flow of air suctioned from the suction holes 21 not blocked by the paper sheet 12, and communication between the suction fan 22 and the suction holes 21 not blocked by the paper sheet 12 is thereby controlled.

The communication control members 30, 31 will be described in detail below.

The movable shield plate 32 of the first communication control member 30 is disposed so as to extend in the paper sheet conveyance direction between the leftmost row of suction holes 21 and the second row of suction holes 21 from the left in the Y-axis direction orthogonal to the paper sheet conveyance direction, as shown in FIG. 2. The movable shield plate 32 of the second communication control member 31 is disposed so as to extend in the paper sheet conveyance direction between the rightmost row of suction holes 21 and the second row of suction holes 21 from the right in the Y-axis direction orthogonal to the paper sheet conveyance direction.

The bracket 36 is disposed on an inside wall surface of the casing 17 corresponding to both end portions of the movable shield plate 32, as shown in FIGS. 3 and 4.

A main body 37 of the movable shield plate 32 is composed of an elongated rectangular plate, a square notched part 38 is formed in a corner part at both ends of the long side thereof, and a rotation rod 39 is provided so as to protrude at the notched part 38. The rotation rod 39 is supported so as to be able to rotate in an insertion hole 40 of the bracket 36 formed integrally with the casing 17, and the movable shield plate 32 can rotate about the rotation rod 39. In other words, the movable shield plate 32 is supported so as to be able to rotate about a shaft center in the suction flow passage 20, and it is possible to adjust the flow rate to the suction fan 22 from the suction holes 21 not blocked by a paper sheet 12 that is less wide than the region in which the plurality of suction holes 21 is arranged.

The torsion coil spring (coil spring) 33 as the urging section is provided on the periphery of the rotation rod 39, one end of the torsion coil spring 33 is in contact with the inside surface of the casing 17, and the other end of the torsion coil spring 33 is in contact with the main body 37 of the movable shield plate 32. An urging force (negative moment) clockwise in FIG. 4 is imparted to the movable shield plate 32 by the torsion coil spring 33.

In a state in which the suction fan 22 is not operating, the torsion coil spring 33 imparts an urging force (negative moment) for maintaining a state in which the movable shield plate 32 is on the side of opening communication between the suction fan 22 and the suction holes 21 not blocked by the paper sheet 12.

An arc-shaped notch 41 is formed in the bracket 36 as shown in FIG. 4, and the main body 37 of the movable shield plate 32 is positioned in the notch 41. The movable shield plate 32 is thereby able to rotate inside the notch 41. One surface (34) of the notch 41 acts as a first range limiter, and the other surface (35) acts as a second range limiter. The first range limiter 34 is a vertical surface, and the movable shield plate 32 can be positioned between the position of contact with the first range limiter 34 and the position of contact with the second range limiter 35.

The movable shield plate 32 is placed in contact with the second range limiter 35 by the urging force of the torsion coil spring 33. This is the initial position. In other words, when the movable shield plate 32 is in contact with the second range limiter 35, the movable shield plate 32 is in a nearly horizontal state and in an open position in which the suction flow passage 20 for the suction fan 22 is at the greatest degree of opening thereof.

When a rotation force (positive moment) is applied to the movable shield plate 32 against the urging force of the torsion coil spring 33, the movable shield plate 32 is able to rotate to the position of contact with the first range limiter 34. When the movable shield plate 32 is in contact with the first range limiter 34, the movable shield plate 32 is in a downward-hanging state and in a closed position in which the suction flow passage 20 for the suction fan 22 is at the greatest degree of closing thereof. The communication control members 30, 31 are thus each provided with the first range limiter 34 with which the movable shield plate 32 is in contact in the state of reducing the flow rate, and when the movable shield plate 32 is in contact with the first range limiter 34, a gap G is also present in the suction flow passage 20 between the suction fan 22 and the suction holes 21 not blocked by the paper sheet 12.

The operation of the printer 11 thus configured will next be described.

In a case in which the suction fan 22 is not activated, the communication control members 30, 31 (movable shield plates 32) are placed in contact with the second range limiters 35 by the torsion coil springs 33. In other words, the movable shield plates 32 are in the open position.

In a case in which the suction fan 22 is activated, the operations described below occur.

Figure 5:
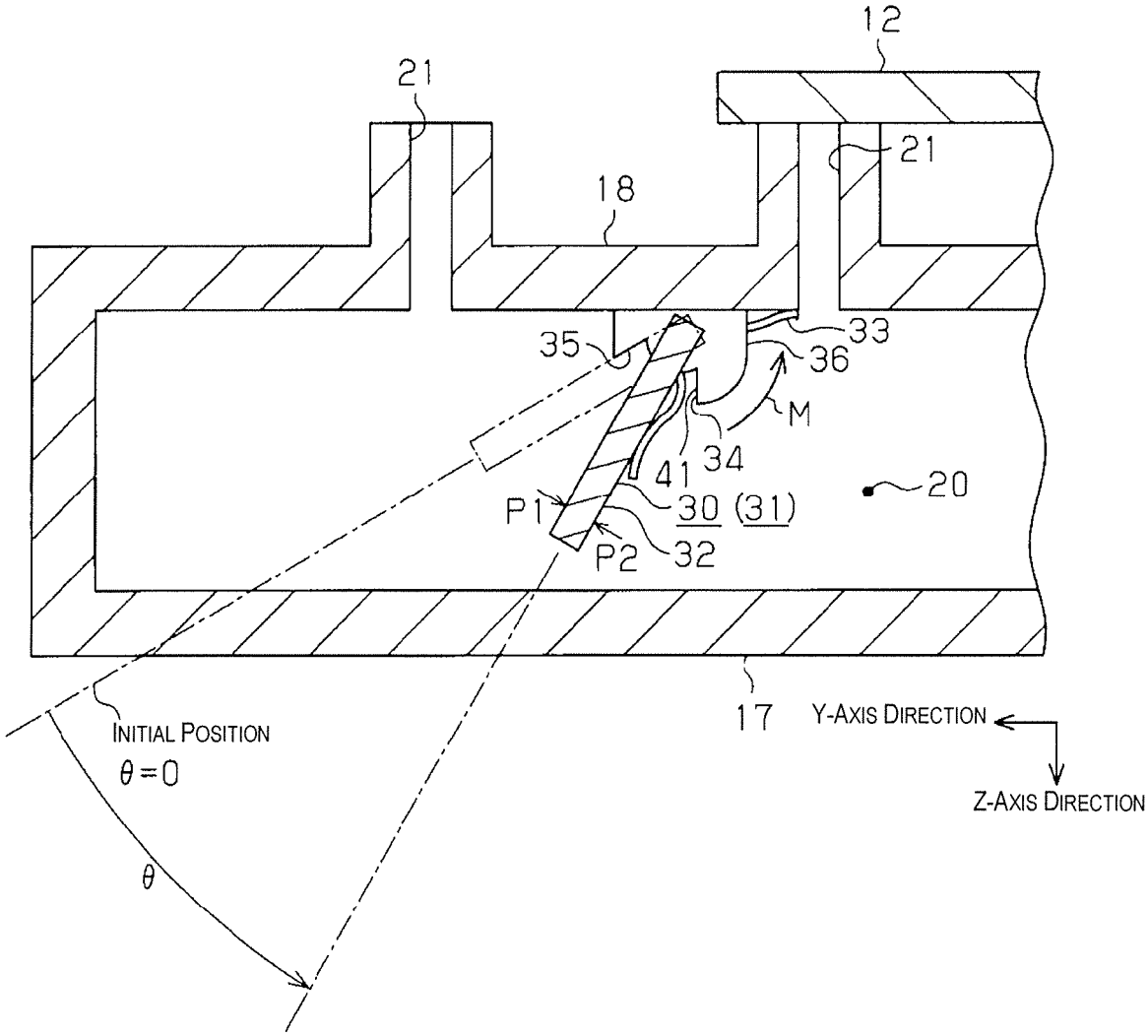
FIG. 5 is a schematic sectional view showing the relevant portions of the printer.

FIG. 5 shows the mechanical relationship during operation. The rotation angle of $\theta=0$ is the initial position of the movable shield plate 32. When using suction to hold a paper sheet 12 that is less wide than the region in which the plurality of suction holes 21 is arranged, a pressure P1 is exerted on the surface of the movable shield plate 32 on the side of the unblocked suction holes 21 by a flow of air suctioned from the suction holes 21 that are not blocked by the paper sheet 12, and a pressure P2 is exerted on the surface of the movable shield plate 32 on the side of the suction fan 22. As a result, on the front and back surfaces of the movable shield plate 32, a pressure difference (=P1−P2) occurs between the space on the side of the suction fan 22 and the space on the side of the suction holes 21 not blocked by the paper sheet 12. The pressure difference (=P1−P2) creates a positive moment at the shaft center on the movable shield plate 32.

As the movable shield plate 32 then closes, the pressure loss (pressure difference P1−P2) gradually increases.

Figure 6:
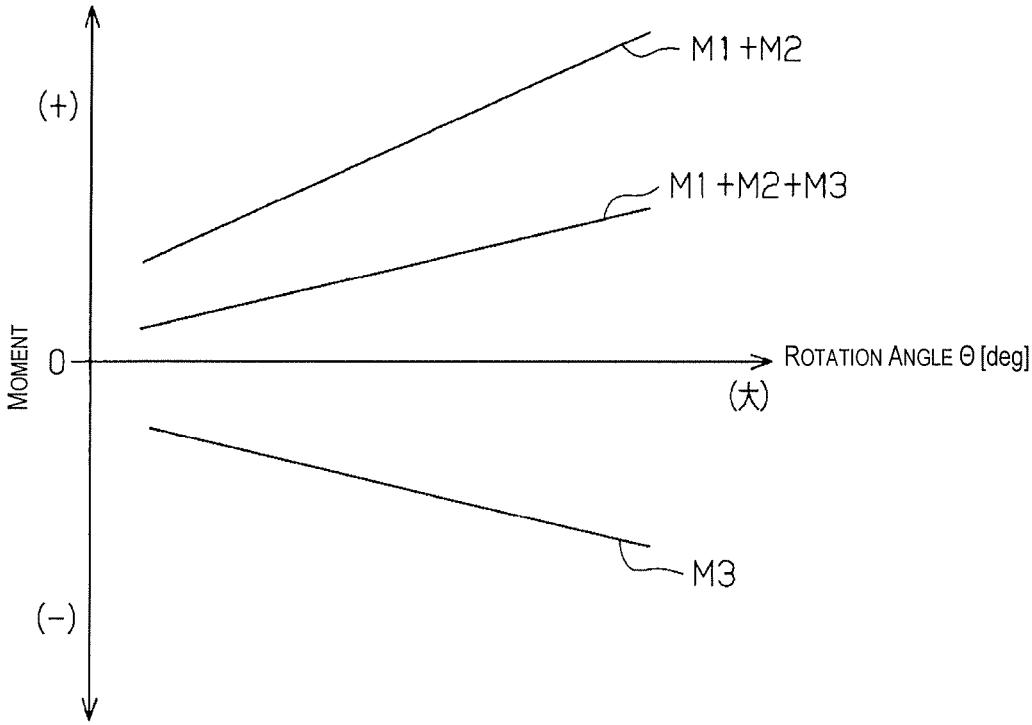
FIG. 6 is a characteristic view showing the relationship between the rotation angle θ and the moment.

FIG. 6 shows the relationship between the rotation angle θ and the moment. In FIG. 6, the moment due to the pressure P1 of FIG. 5 is designated as "M1," the moment due to the pressure P2 is designated as "M2," and the moment due to the torsion coil spring 33 is designated as "M3." FIG. 6 shows the characteristic line for (M1+M2), the characteristic line for M3, and the characteristic line for (M1+M2+M3).

At the initial position, the relationship of the moments is such that M1+M2+M3 is positive. In other words, $$M1+M2+M3>0 \quad \text{Eq. (1).}$$

The movable shield plate 32 rotates in the closing direction.

The relationship of Equation (1) above is also in effect during rotation of the movable shield plate 32. In other words, the urging force (moment M3) of the torsion coil spring 33 is set so that an oppositely directed moment (M3) acts that is weaker than the moment (=M1+M2) created at the shaft center by the pressure difference (=P1−P2) between the space on the side of the suction holes 21 and the space on the side of the suction fan 22, and the movable shield plate 32 attains the closing position (state on the side of reducing the flow rate to the suction fan 22 from the suction holes 21 not blocked by the paper sheet 12). The movable shield plate 32 can thereby rotate until the movable shield plate 32 comes in contact with the first range limiter 34, and the movable shield plate 32 can be rotated to the state on the side of reducing the flow rate.

As the rotation angle θ increases, the sum (=M1+M2) of the moment M1 due to the pressure P1 and the moment M2 due to the pressure P2 increases.

The air flow speed of the suction holes 21 significantly decreases as the movable shield plate 32 closes.

Figure 7:
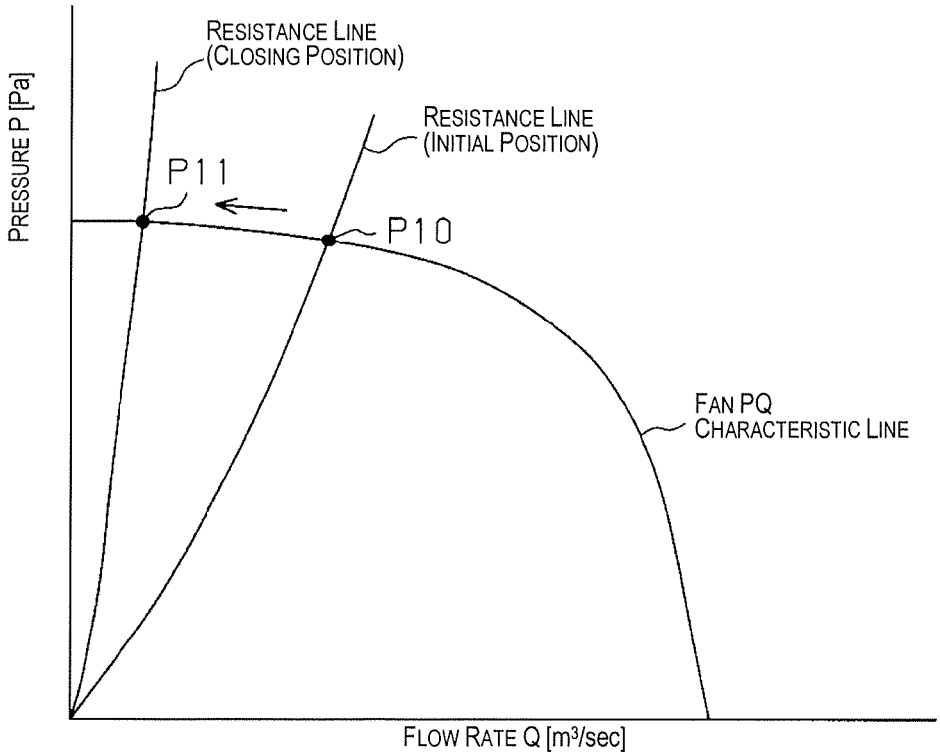
FIG. 7 is a characteristic view showing the fan PQ characteristic line and resistance lines for the flow rate Q and the pressure P.

This relationship is described using FIG. 7. The horizontal axis of FIG. 7 indicates the flow rate Q, and the vertical axis indicates the pressure P. FIG. 7 shows the flow rate/pressure characteristic line (PQ characteristic line) of the suction fan 22, and shows the pressure chamber resistance line at the initial position and the pressure chamber resistance line at the closing position.

In FIG. 7, the flow rate is lower at the intersection P11 of the resistance line at the closing position than at the intersection P10 of the resistance line at the initial position with respect to the PQ characteristic line of the suction fan 22. In other words, based on the relationship of the PQ characteristic of the suction fan 22 and the pressure loss due to the movable shield plate 32, the flow rate and flow speed of the suction holes 21 decrease.

Figure 8:
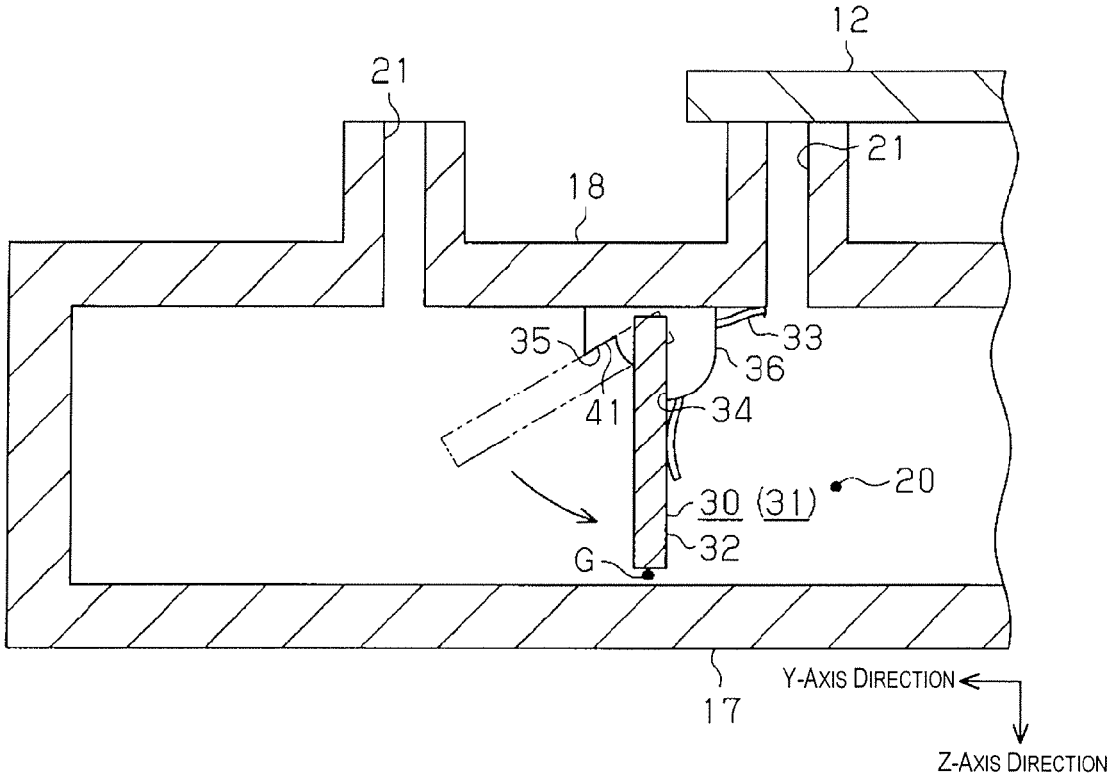
FIG. 8 is a schematic sectional view showing the relevant portions of the printer.

In the mode during operation, in a case in which the suction holes 21 at the end portions of the platen in FIG. 8 are open, the moment relationship at the initial position is such that M1+M2+M3>0, and the movable shield plate 32 rotates in the closing direction (the relationship indicated by the above equation being in effect during rotation as well). As the movable shield plate 32 closes until reaching the first range limiter 34, the air flow speed from the suction holes 21 not blocked by the paper sheet 12 decreases. Furthermore, the movable shield plate 32 comes in contact with the first range limiter 34 and reaches the closing position, a state is maintained in which the air flow rate and flow speed from the suction holes 21 not blocked by the paper sheet 12 are at minimum, and air flow from the suction holes 21 not blocked by the paper sheet 12 can be suppressed.

As a result, it is possible to suppress landing deviation of the ink from the recording head 15 onto the paper sheet 12, caused by a flow of air suctioned from the suction holes 21 not blocked by the paper sheet 12 when suction is used to hold a paper sheet 12 that is less wide than the region in which the plurality of suction holes 21 is arranged in the platen 18. Suction can also be provided from the suction holes 21 that are necessary for suctioning the paper sheet 12, without blockage of the suction holes 21 near the recording head 15 in the platen 18, and the print surface of the paper sheet can be prevented from rising upward.

Figure 9:
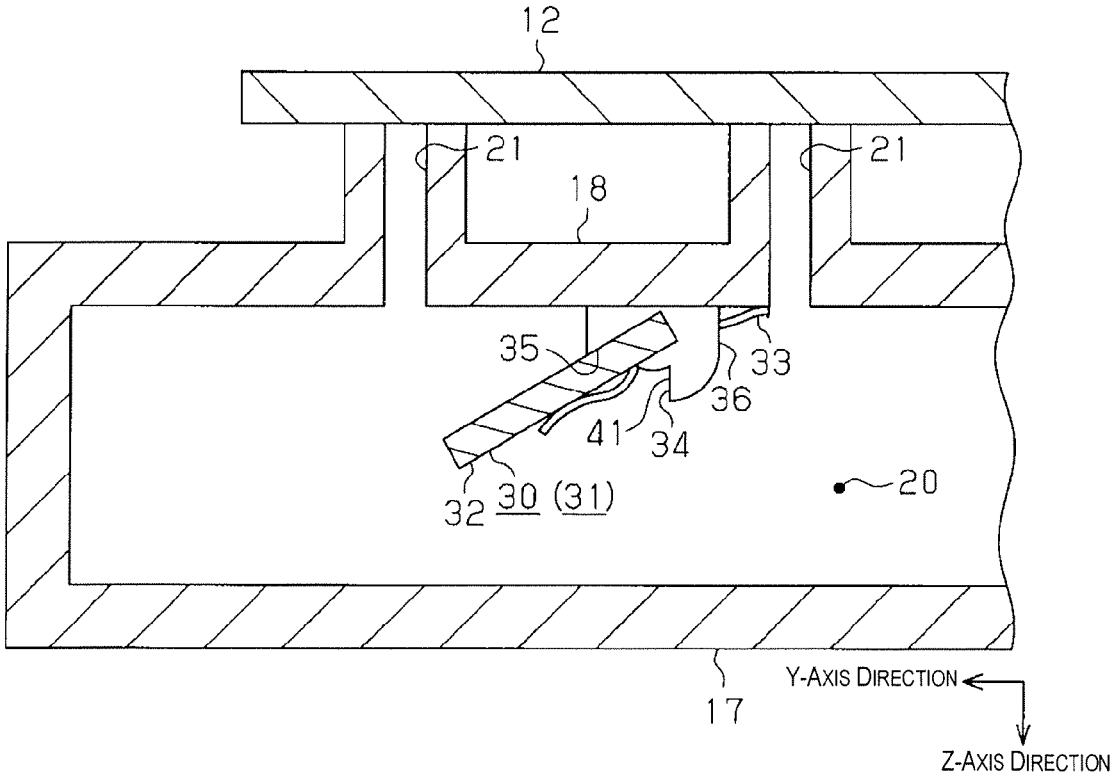
FIG. 9 is a schematic sectional view showing the relevant portions of the printer.

In a case in which the suction holes 21 at the end portion of the platen shown in FIG. 9 are blocked, since there is also no longer a pressure difference (=P1−P2) inside the suction flow passage (pressure chamber) 20 in the casing 17, M1+M2=0, and the movable shield plate 32 is maintained in the initial position. In other words, the suction force of the suction holes 21 is maintained.

Such effects as those described below can be obtained through the embodiment described above.

(1) The communication control members 30, 31 (movable shield plates 32) are provided in the vicinity of the suction holes 21 in the suction flow passage (pressure chamber) 20 in the casing 17, and the communication control members 30, 31 are disposed toward the suction fan 22 with respect to the suction holes 21 for which there is a need to adjust the suction flow speed. The flow speed from suction holes 21 that are not needed for suctioning the paper sheet is thereby suppressed, and landing deviation in the vicinity of such suction holes 21 can be reduced. In other words, in the suction platen 18, landing deviation caused by the flow speed of suction holes 21 not blocked by the paper sheet is suppressed. There is also no loss of suction force from the holes that are necessary for suctioning the paper sheet. The configuration of the device is also simplified.

In a case in which a shield is used which moves synchronously with the carriage and blocks the suction holes, as described in Japanese Laid-Open Patent Publication No. 2009-234128, since the shield moves synchronously with the carriage (head), the motor load increases, vibration or noise is prone to occur, and the mechanism is complex and thus inconvenient in terms of layout and cost. However, the present embodiment does not use a shield which moves synchronously with the carriage and blocks the suction holes, and drawbacks such as those described above can thus be prevented.

(2) When the movable shield plate 32 as a movable flow rate adjustment member is in contact with the first range limiter 34, since a gap G is present in the suction flow passage 20 between the suction fan 22 and the suction holes 21 not blocked by the paper sheet 12, the movable shield plate 32 can easily be adjusted.

(3) Since the torsion coil spring 33 serving as an urging section is used for urging the movable shield plate 32, the variation in the urging force can be made smaller when the rotatably supported movable shield plate 32 as the movable flow rate adjustment member is rotated.

In order to stably maintain a state in which M1+M2+M3>0 despite variation of the rotation angle θ, the spring constant must be set to a small value, and a torsion coil spring is therefore preferred as the urging section for urging the movable shield plate 32.

The embodiment described above may be modified as described below.

In the embodiment described above, the torsion coil spring 33 is used as a member for urging the movable shield plate 32, but any member may be used which urges the surface which receives pressure from the side of the platen suction holes, and a movable member which receives pressure from the side of the suction fan 22 in the suction flow passage 20, toward the side of opening communication.

In FIG. 1, the plurality of suction holes 21 is formed so as to be aligned in a straight line at a constant pitch in the X-axis direction, which is the conveyance direction of the paper sheet 12, and arranged at a constant pitch in the Y-axis direction orthogonal to the conveyance direction of the paper sheet. However, the suction holes 21 need not necessarily be arranged at a constant pitch (equal pitch) and in a straight line insofar as the suction holes 21 enable the paper sheet 12 to be held by suction to the platen 18.

In FIG. 2, the communication control members 30, 31 (movable shield plates 32) extending in the paper sheet conveyance direction are disposed between the row of suction holes 21 at each end and the second row of suction holes 21 from each end in the direction orthogonal to the paper sheet conveyance direction. However, as shown in FIG. 10, additional communication control members 50, 51 (movable shield plates 32) may be provided extending in the paper sheet conveyance direction and disposed between the $n^{th}$ row of suction holes 21 from each end and the (n+1)th row of suction holes 21 from each end in the direction orthogonal to the paper sheet conveyance direction, where n is an integer equal to 2 or greater. FIG. 10 shows a case in which n=2, and the communication control members 50, 51 (movable shield plates 32) extending in the paper sheet conveyance direction are disposed between the second and third rows of suction holes 21 from each end in the direction orthogonal to the paper sheet conveyance direction.

In the embodiment described above, a gap G is present when the movable shield plate 32 is closed, but a configuration may be adopted in which there is no gap. In short, the opening may be narrowed (fully closed or open).

In the embodiment described above, the inkjet printer 11 is described as a specific example of the liquid ejection device, but a liquid ejection device may also be employed which ejects or discharges a liquid other than ink. The present invention may be applied to various types of liquid ejection devices provided with a liquid ejection head or the like for discharging minute droplets. The term "droplet" refers to the state of the liquid discharged from the liquid ejection device, and includes droplets which leave granular, teardrop-shaped, or filament-shaped traces. The droplets referred to herein are composed of a material which can be ejected by the liquid ejection device. For example, the droplets are in a state in which the material thereof is in the liquid phase, and include not only fluids and materials that are liquid in one state thereof, such as high or low-viscosity liquids, sol/gel solutions, and other inorganic solvents, organic solvents, solutions, liquid resins, and liquid metals (metal liquids), but droplets in which particles of functional material composed of pigments, metal particles, and other solids are dissolved, dispersed, or mixed in a solvent. Ink, liquid crystal, or the like such as described in the embodiment above are cited as typical examples of the liquid. The term "ink" includes common water-based ink, oil-based ink, gel ink, hot-melt ink, and various other liquid compositions. Specific examples of the liquid ejection device may include liquid ejection devices for ejecting liquid which includes electrode material, color material, or other material in dispersed or dissolved form for use in such applications as manufacturing liquid crystal displays, EL (electroluminescent) displays, surface-emitting displays, and color filters; liquid ejection devices for ejecting biological organic materials used to manufacture biochips; liquid ejection devices used as precision pipettes for ejecting liquids as test samples; and printing devices, microdispensers, and the like. Liquid ejection devices for ejecting lubricating oil with pinpoint precision onto a clock, camera, or other precision machine; liquid ejection devices for ejecting UV-curing resin or other transparent resin liquids onto a substrate to form micro hemispherical lenses (optical lenses) used in an optical communication device or the like; and liquid ejection devices for ejecting acid or alkaline etching solution for etching a substrate or the like may be used. The present invention may be applied to any of these types of liquid ejection devices.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a carriage configured to mount a liquid ejection head for ejecting a liquid;

a platen having a plurality of suction holes including a first suction hole and a second suction hole disposed adjacent to the first suction hole, the first suction hole being configured not to be blocked and the second suction hole being configured to be blocked, the platen being disposed in a position facing a movement region of the carriage;

a suction unit configured to generate a negative pressure;

a suction flow passage configured to transmit the negative pressure generated by the suction unit to the platen, the suction flow passage being disposed between the suction unit and the platen; and a communication control unit provided between the first suction hole and the second suction hole in the suction flow passage so that communication between the suction unit and the first suction hole is controlled by a flow of air suctioned from the first suction hole, the communication control unit being movable between a first side of opening communication between the suction unit and the first suction hole and a second side of the opening communication that reduces a rate of flow toward the suction unit from the first suction hole, the communication control unit being configured to commence to move from the first side to the second side in response to activation of the suction unit.

2. The liquid ejection device according to claim 1, wherein the liquid ejection head ejects the liquid onto a recording medium, and the platen holdes the recording medium by suction using at least one of the first and second suction holes.

3. The liquid ejection device according to claim 2, wherein the first suction hole is not blocked by the recording medium, and the second suction hole is blocked by the recording medium as suction is used to hold the recording medium that is less wide than the region in which first and second suction holes are arranged.

4. A liquid ejection device comprising:

a carriage configured to mount a liquid ejection head for ejecting a liquid;

a platen having a plurality of suction holes including a first suction hole and a second suction hole disposed adjacent to the first suction hole, the first suction hole being configured not to be blocked and the second suction hole being configured to be blocked, the platen being disposed in a position facing a movement region of the carriage;

a suction unit configured to generate a negative pressure;

a suction flow passage configured to transmit the negative pressure generated by the suction unit to the platen, the suction flow passage being disposed between the suction unit and the platen; and a communication control unit provided between the first suction hole and the second suction hole in the suction flow passage so that communication between the suction unit and the first suction hole is controlled by a flow of air suctioned from the first suction hole, the communication control unit being movable between a first side of opening communication between the suction unit and the first suction hole and a second side of the opening communication that reduces a rate of flow toward the suction unit from the first suction hole, the communication control unit being configured to commence to move from the first side to the second side in response to activation of the suction unit, the communication control unit including a movable flow rate adjustment member supported to rotate about a shaft center in the suction flow passage so as to enable adjustment of the rate of flow to the suction unit from the first suction hole, and an urging section configured to impart an urging force for maintaining a state in which the movable flow rate adjustment member is on the first side as the suction unit is not operating.

5. The liquid ejection device according to claim 4, wherein the urging force of the urging section is set so that an oppositely directed moment that is weaker than a moment created at the shaft center acts by a pressure difference, which is created by a flow of air suctioned from the first suction hole, between a space on a first surface side of the movable flow rate adjustment member toward the suction unit and on a second surface side of the movable flow rate adjustment member toward the first suction hole, and a state is achieved in which the movable flow rate adjustment member is on the second side of reducing the rate of flow toward the suction unit from the first suction hole.

6. The liquid ejection device according to claim 4, wherein the communication control unit includes a range limiter with which the movable flow rate adjustment member comes in contact in the state on the second side of reducing the flow rate, and when the movable flow rate adjustment member is in contact with the range limiter, a gap is present in the suction flow passage between the suction unit and the first suction hole.

7. The liquid ejection device according to claim 4, wherein the urging section is a torsion coil spring.

* * * * *